US007513451B2

(12) United States Patent
Virving et al.

(10) Patent No.: US 7,513,451 B2
(45) Date of Patent: Apr. 7, 2009

(54) REFINING ELEMENT

(75) Inventors: Nils Virving, Hässelby (SE); Pertti Purolainen, Bro (SE); Lars Holmsten, Vallentuna (SE)

(73) Assignee: Metso Paper, Inc. (FI)

( * ) Notice: Subject to any disclaimer, the term of this patent is extended or adjusted under 35 U.S.C. 154(b) by 67 days.

(21) Appl. No.: 10/585,752

(22) PCT Filed: Jan. 17, 2005

(86) PCT No.: PCT/SE2005/000035

§ 371 (c)(1),
(2), (4) Date: Jul. 12, 2006

(87) PCT Pub. No.: WO2005/070550

PCT Pub. Date: Aug. 4, 2005

(65) Prior Publication Data

US 2007/0095962 A1 May 3, 2007

(30) Foreign Application Priority Data

Jan. 21, 2004 (SE) ..... 0400121

(51) Int. Cl.
*B02C 7/12* (2006.01)

(52) U.S. Cl. ..... 241/298

(58) Field of Classification Search ..... 241/298, 241/261.2, 261.3, 296, 297
See application file for complete search history.

(56) References Cited

U.S. PATENT DOCUMENTS

| | | | | |
|---|---|---|---|---|
| 1,325,413 | A * | 12/1919 | Phillips | 241/298 |
| 5,362,003 | A | 11/1994 | Virving | |
| 5,526,992 | A * | 6/1996 | Hawen et al. | 241/298 |
| 6,032,888 | A * | 3/2000 | Deuchars | 241/261.3 |
| 6,402,071 | B1 | 6/2002 | Gingras | |
| 6,592,062 | B1 | 7/2003 | Virving | |
| 2005/0211809 | A1 * | 9/2005 | Lutz | 241/261.2 |

FOREIGN PATENT DOCUMENTS

EP 1 088 932 A2 4/2001

* cited by examiner

*Primary Examiner*—Mark Rosenbaum
(74) *Attorney, Agent, or Firm*—Lerner, David, Littenberg, Krumholz & Mentlik, LLP

(57) ABSTRACT

A refining element for use in the refining of fibrous materials is disclosed in which the refining surface includes an inner portion and an outer portion defining a transition region between these two portions, a plurality of bars and grooves in the inner portion of the refining surface, and a plurality of bars and intermediate grooves in the outer portion of the refining surface, the bars in the inner surface having a greater width than those in the outer surface, and the transition region having a varying distance from the inner edge of the refining element across the refining surface.

2 Claims, 1 Drawing Sheet

REFINING ELEMENT

FIELD OF THE INVENTION

The present invention relates disc-type refiners, with refining discs rotating opposedly relative to one another. The refining discs are provided with refining elements, which between themselves form a refining gap with a refining zone for the working of fibrous material. The fibrous material is preferably lignocellulosic fibrous material, and the refiner is used for the manufacture of, for example, reject pulp, recycled fiber pulp and mechanical pulps, such as board pulp, thermomechanical pulp (TMP) and chemi-thermomechanical pulp (CTMP) and for the low concentration refining of chemical pulps.

More particularly, the present invention relates to a refining element to be used in a refiner of the type described above.

BACKGROUND OF THE INVENTION

A refining element is generally formed with a pattern of bars and intermediate grooves. The bars and grooves are formed in different ways, depending on which fibrous material is worked and the degree of working desired, and thus in the case of lignocellulosic material, which pulp quality is desired. The bars, for example, can be continuous or discontinuous, and can be arranged in different patterns. The working of the fibrous material is carried out substantially by the bars of the refining elements. The refining gap is formed so that the fibrous material, as seen in the radial direction, passes from the inside outwardly. Farthest inwardly in the refining gap, in an inner portion, or the in-feeding zone, the refining elements are normally formed with wide bars (coarse pattern) for bringing about a first disintegration of the material and for advancing the material outwardly in the refining gap. A certain defibering, i.e. a separation of the fibers of the material, also takes place in the inner portion of the refining gap, where the distance between the refining surfaces is the greatest. The refining gap decreases thereafter outwardly, i.e. the distance between the opposed refining surfaces decreases and transforms to a refining zone, at the same time as the bars become thinner (finer pattern), in order to achieve a desired working or refining of the fibrous material. The bars in the outer portion are placed at a greater density, which implies more bar edges for effecting the main working of the material. The outer portion can comprise more zones, in which case the pattern is usually made tighter from one zone to the other, radially outwardly.

In the transition from the inner portion with the coarse pattern to the outer portion with the finer pattern, the material is slowed down. This implies compression of the material and increased load on the bars of the refining element in this position. As a result thereof the bars of the refining element in the transition between the inner and outer portion of the refining element are subjected to increasing wear.

SUMMARY OF THE INVENTION

In accordance with the present invention, the above-referenced difficulties have been dealt with by the discovery of a refining element for application to a refiner for the treatment of fibrous material comprising an inner edge, and a pair of side edges defining a refining surface, an inner portion of the refining surface proximate to the inner edge, and an outer portion of the refining surface displaced radially outwardly from the inner portion thereby defining a transition region between the inner portion and the outer portion, a plurality of first bars and intermediate grooves disposed on the inner portion of the refining surface, and a plurality of second bars and intermediate grooves disposed on the outer portion of the refining surface, the plurality of first bars having a greater width than the plurality of second bars, the transition region having a varying distance from the inner edge of the refining element across the refining surface. In a preferred embodiment, the transition region is arc shaped over the refining surface. In accordance with another embodiment, the distance from the transition region to the inner edge of the refining element increases continuously from one of the side edges of the refining element to the other of the side edges of the refining element.

The present invention thus offers a solution to the aforesaid problems. According to the present invention, the transition between the inner and outer portion of the refining element is formed with arc-shaped varying radial distances from the inner edge of the refining element. Thereby the transition of the material from the in-feeding zone to the refining zone is distributed over a greater area of the refining element, and the problem of wear is reduced substantially.

BRIEF DESCRIPTION OF THE DRAWINGS

The invention is described in greater detail in the following detailed description, with reference to the accompanying Figures illustrating an embodiment of the present invention, in which.

DETAILED DESCRIPTION

Figure 3:
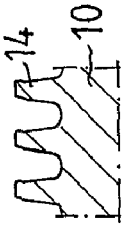
FIG. 3 is a front, elevational, cross-sectional view taken along segment B-B in FIG. 1, of the bars in the outer portion of the refining element.
Figure 4:
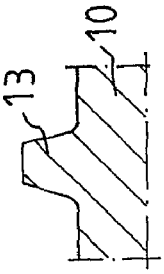
FIG. 4 is a front, elevational, cross-sectional view taken along segment C-C in FIG. 1 of the bars in the inner portion of the refining element.
Figure 2:
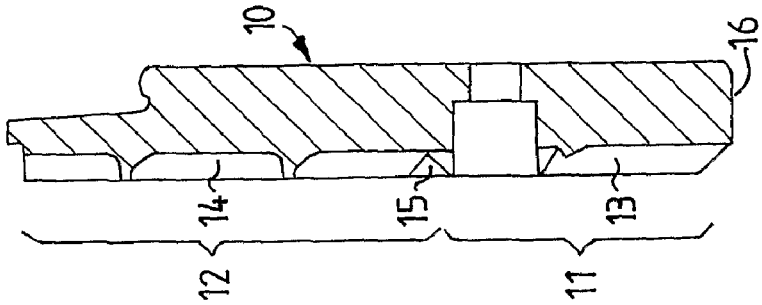
FIG. 2 is a side, elevational, cross-sectional view taken along segment A-A in FIG. 1.
Figure 1:
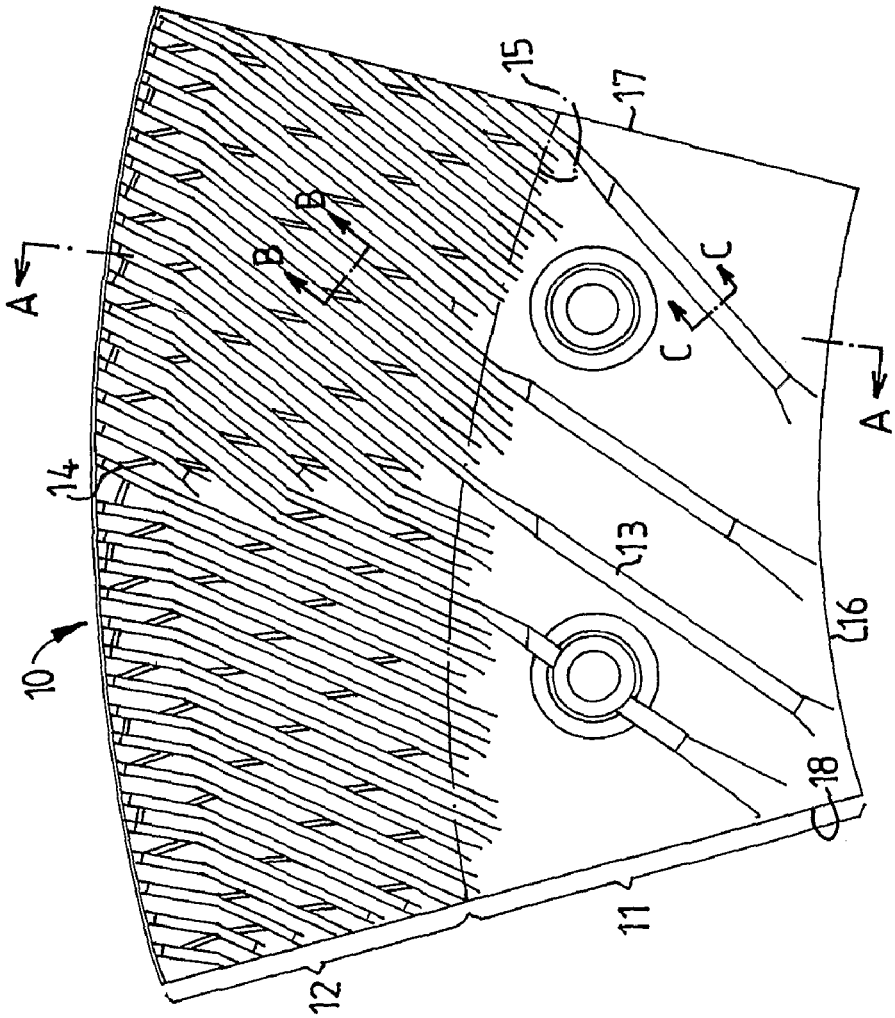
FIG. 1 is a top, elevational view of a refining element of the present invention with a pattern of bars and intermediate grooves.

In FIG. 1 a refining element 10 is shown, which is intended for the refining of fibrous material. The refining element 10 is provided with a pattern of bars and intermediate grooves and is divided into an inner portion 11 and an outer portion 12. The inner portion 11 has a coarse pattern with wide bars 13, while the outer portion has a fine pattern with narrow bars 14. The transition between these portions is designated by reference numeral 15.

The bars 13 in the inner portion 11 of the refining element are intended to bring about a first disintegration of the material and to advance the material outwardly in the refining gap. A certain defibering, i.e. separation of the fibers of the material, also takes place in this portion of the refining element. The bars 14 in the outer portion 12 of the refining element are intended to effect a desired working or refining of the fibrous material.

The transition 15 between the inner portion 11 and the outer portion 12 extends arc-shaped with varying radial distance from the inner edge 16 of the refining element. The refining element is suitably formed so that the distance of the transition 15 from the inner edge 16 increases continuously from one lateral edge 17 of the refining element to the other one 18. But also other configurations of the transition can also be imagined. The radial distance from the inner edge 16 can, for example, increase and decrease one or several times over the refining element. What is essential is that the transition 15 is not located on the same radius over the entire refining element.

The bars, 13 and 14, are suitably angled in relation to the radius of the refining element, so that during the working of the material they promote an outward feeding. The distance of the transition 15 from the inner edge 16 shall then increase, counted in the intended direction of rotation of the refining element.

When refining elements according to the present invention are used in a refiner, they are placed directly in front of each other on opposed refining discs (refining element holders) for rotation relative to each other. Due to the fact that the transition 15 between the inner and outer portions, 11 and 12, respectively, of the refining elements varies radially, the effect of the material on the refining elements at the transition is distributed over a greater area. This implies that the wear is substantially reduced, and the service life of the refining elements increases, and at the same time the feeding will be more uniform and improved. This results altogether in that the operational safety can be improved and the pulp quality be increased.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A refining element for application to a refiner for the treatment of fibrous material comprising an inner edge, and a pair of side edges defining a refining surface, an inner portion of said refining surface proximate to said inner edge, and an outer portion of said refining surface displaced radially outwardly from said inner portion thereby defining a transition region between said inner portion and said outer portion, a plurality of first bars and intermediate grooves disposed on said inner portion of said refining surface, said plurality of first bars extending substantially from said inner edge of said refining element to said transition region, and a plurality of second bars and intermediate grooves disposed on said outer portion of said refining surface, said plurality of first bars having a greater width than said plurality of second bars, said transition region being arc-shaped over said refining surface.

2. A refining element for application to a refiner for the treatment of fibrous material comprising an inner edge, and a pair of side edges defining a refining surface, an inner portion of said refining surface proximate to said inner edge, and an outer portion of said refining surface displaced radially outwardly from said inner portion thereby defining a transition region between said inner portion and said outer portion, a plurality of first bars and intermediate grooves disposed on said inner portion of said refining surface, said plurality of first bars extending substantially from said inner edge of said refining element to said transition region, and a plurality of second bars and intermediate grooves disposed on said outer portion of said refining surface, said plurality of first bars having a greater width than said plurality of second bars, the distance from said transition region to said inner edge of said refining element increasing continuously from one of said side edges of said refining element to the other of said side edges of said refining element.

* * * * *